US010668473B2

(12) United States Patent
Pearcy et al.

(10) Patent No.: US 10,668,473 B2
(45) **Date of Patent: *Jun. 2, 2020**

(54) REAGENT PREPARATION ASSEMBLY

(71) Applicant: Biolyph, LLC, Chaska, MN (US)

(72) Inventors: Timothy Pearcy, Eden Prairie, MN (US); James G. Skakoon, St. Paul, MN (US)

(73) Assignee: Biolyph, LLC, Chaska, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/524,922

(22) Filed: Jul. 29, 2019

(65) Prior Publication Data

US 2019/0351420 A1 Nov. 21, 2019

Related U.S. Application Data

(63) Continuation of application No. 14/597,677, filed on Jan. 15, 2015, now Pat. No. 10,406,524, which is a (Continued)

(51) Int. Cl.
*B01F 1/00* (2006.01)
*B01F 13/00* (2006.01)
*B01L 3/00* (2006.01)

(52) U.S. Cl.
CPC ..... *B01L 3/523* (2013.01); *B01F 13/0023* (2013.01); *B01L 3/52* (2013.01); (Continued)

(58) Field of Classification Search
CPC ..... B01F 1/0005; B01F 13/0023 (Continued)

(56) References Cited

U.S. PATENT DOCUMENTS 2,176,041 A 10/1939 Pittenger
2,591,706 A 4/1952 Lockhart
(Continued)

FOREIGN PATENT DOCUMENTS

AU 2011276396 B2 8/2014
AU 2014280969 A1 2/2015
(Continued)

OTHER PUBLICATIONS

US 8,807,178 B2, 08/2014, Pearcy (withdrawn)
(Continued)

*Primary Examiner* — David L Sorkin
(74) *Attorney, Agent, or Firm* — Schwegman Lundberg & Woessner, P.A.

(57) ABSTRACT

A reagent preparation assembly includes a body and a reaction chamber adjacent the body, the reaction chamber includes a reagent therein, such as a lyophilized reagent. An access port extends into the reaction chamber, and the access port is configured to receive an instrument. A seal extends across a portion of the reaction chamber and the access port. A reconstitution assembly is movably coupled with the body. The reconstitution assembly includes a plunger, a syringe and a piston. The plunger is movably coupled with the body. The syringe is selectively engaged with the plunger. The syringe includes a solution reservoir containing a solution, and movement of the syringe pierces the seal. The piston is selectively engaged with the plunger, and the piston is movably coupled within the syringe. Movement of the piston pushes the solution into the reaction chamber.

10 Claims, 14 Drawing Sheets

Related U.S. Application Data continuation of application No. 13/805,166, filed as application No. PCT/US2011/042443 on Jun. 29, 2011, now Pat. No. 8,973,749.

(60) Provisional application No. 61/359,636, filed on Jun. 29, 2010.

(52) U.S. Cl.
CPC ..... *B01L 2200/16* (2013.01); *B01L 2300/044* (2013.01); *B01L 2300/0672* (2013.01); *B01L 2400/0478* (2013.01); *B01L 2400/0683* (2013.01); *Y10T 29/49826* (2015.01)

(58) Field of Classification Search
USPC ..... 206/222; 604/87, 88
See application file for complete search history.

(56) References Cited

U.S. PATENT DOCUMENTS

| | | | | |
|---|---|---|---|---|
| 3,489,147 | A * | 1/1970 | Shaw | A61J 1/2093 604/88 |
| 3,834,387 | A | 9/1974 | Brown | |
| 4,031,892 | A | 6/1977 | Hurschman | |
| 4,226,236 | A | 10/1980 | Genese | |
| 4,515,753 | A | 5/1985 | Smith et al. | |
| 4,516,967 | A | 5/1985 | Kopfer | |
| 4,693,706 | A | 9/1987 | Ennis, III et al. | |
| 4,768,568 | A | 9/1988 | Fournier et al. | |
| 4,834,149 | A | 5/1989 | Fournier et al. | |
| 4,973,168 | A | 11/1990 | Chan | |
| 5,000,922 | A | 3/1991 | Turpen | |
| 5,071,769 | A | 12/1991 | Kundu et al. | |
| 5,199,949 | A | 4/1993 | Haber et al. | |
| 5,232,664 | A | 8/1993 | Krawzak et al. | |
| 5,277,873 | A | 1/1994 | Hsei | |
| 5,281,198 | A | 1/1994 | Haber et al. | |
| 5,449,494 | A | 9/1995 | Seeney | |
| 5,605,542 | A | 2/1997 | Tanaka et al. | |
| 5,637,087 | A | 6/1997 | O'Neil et al. | |
| 5,704,918 | A | 1/1998 | Higashikawa | |
| 5,785,682 | A | 7/1998 | Grabenkort | |
| 5,827,262 | A | 10/1998 | Neftel et al. | |
| 5,865,799 | A | 2/1999 | Tanaka et al. | |
| 5,869,003 | A | 2/1999 | Nason | |
| 5,879,635 | A | 3/1999 | Nason | |
| 5,899,881 | A | 5/1999 | Grimard et al. | |
| 5,951,160 | A | 9/1999 | Ronk | |
| 5,965,453 | A | 10/1999 | Skiffington et al. | |
| 5,971,953 | A | 10/1999 | Bachynsky | |
| 6,045,755 | A | 4/2000 | Lebl et al. | |
| 6,048,735 | A | 4/2000 | Hessel et al. | |
| 6,248,294 | B1 | 6/2001 | Nason | |
| 6,284,549 | B1 | 9/2001 | Guthrie | |
| 6,406,175 | B1 | 6/2002 | Marino | |
| 6,419,656 | B1 | 7/2002 | Vetter et al. | |
| 6,481,435 | B2 | 11/2002 | Hochrainer et al. | |
| 6,488,894 | B1 | 12/2002 | Miethe et al. | |
| 6,551,834 | B2 | 4/2003 | Carpenter et al. | |
| 6,569,125 | B2 | 5/2003 | Jepson et al. | |
| 6,632,681 | B1 | 10/2003 | Chu | |
| 6,641,561 | B1 | 11/2003 | Hill et al. | |
| 6,656,150 | B2 | 12/2003 | Hill et al. | |
| 6,702,778 | B2 | 3/2004 | Hill et al. | |
| 6,770,052 | B2 | 8/2004 | Hill et al. | |
| 6,817,987 | B2 | 11/2004 | Vetter et al. | |
| 6,820,506 | B2 | 11/2004 | Kipke et al. | |
| 6,863,866 | B2 | 3/2005 | Kelly et al. | |
| 6,878,338 | B2 | 4/2005 | Taylor et al. | |
| 6,924,498 | B2 | 8/2005 | Feldsine et al. | |
| 6,953,445 | B2 | 10/2005 | Wilmot et al. | |
| 6,986,346 | B2 | 1/2006 | Hochrainer et al. | |
| 7,030,403 | B2 | 4/2006 | Feldsine et al. | |
| 7,040,311 | B2 | 5/2006 | Hochrainer et al. | |
| 7,090,803 | B1 | 8/2006 | Gould et al. | |
| 7,329,235 | B2 | 2/2008 | Bertron et al. | |
| 7,967,779 | B2 | 6/2011 | Bertron et al. | |
| 8,329,119 | B2 | 12/2012 | Pearcy et al. | |
| 8,919,390 | B2 | 12/2014 | Pearcy et al. | |
| 8,940,539 | B2 | 1/2015 | Pearcy et al. | |
| 8,973,749 | B2 | 3/2015 | Pearcy et al. | |
| 9,889,442 | B2 | 2/2018 | Pearcy et al. | |
| 10,406,524 | B2 * | 9/2019 | Pearcy | B01L 3/52 |
| 2001/0016703 | A1 | 8/2001 | Wironen et al. | |
| 2003/0039588 | A1 | 2/2003 | Miethe et al. | |
| 2003/0157564 | A1 | 8/2003 | Smith et al. | |
| 2003/0209653 | A1 | 11/2003 | Feldsine et al. | |
| 2003/0235512 | A1 | 12/2003 | Carpenter et al. | |
| 2004/0097874 | A1 | 5/2004 | Griffiths et al. | |
| 2004/0138611 | A1 | 7/2004 | Griffiths et al. | |
| 2004/0170533 | A1 | 9/2004 | Chu | |
| 2005/0075602 | A1 | 4/2005 | Cherif-cheikh et al. | |
| 2005/0075604 | A1 | 4/2005 | Lee | |
| 2006/0052747 | A1 | 3/2006 | Nishimura et al. | |
| 2006/0079834 | A1 | 4/2006 | Tennican et al. | |
| 2006/0116644 | A1 | 6/2006 | Norton | |
| 2006/0139631 | A1 | 6/2006 | Feldsine et al. | |
| 2006/0169348 | A1 | 8/2006 | Yigal | |
| 2006/0184103 | A1 | 8/2006 | Paproski et al. | |
| 2006/0216196 | A1 | 9/2006 | Satoh et al. | |
| 2007/0014690 | A1 | 1/2007 | Lawrence et al. | |
| 2008/0188799 | A1 | 8/2008 | Mueller-beckhaus et al. | |
| 2008/0188828 | A1 | 8/2008 | Reynolds et al. | |
| 2008/0300551 | A1 | 12/2008 | Schiller et al. | |
| 2009/0117646 | A1 | 5/2009 | Stordeur et al. | |
| 2010/0249753 | A1 | 9/2010 | Gaisser et al. | |
| 2011/0127294 | A1 | 6/2011 | Pearcy et al. | |
| 2011/0224610 | A1 | 9/2011 | Lum et al. | |
| 2011/0224611 | A1 | 9/2011 | Lum et al. | |
| 2011/0224612 | A1 | 9/2011 | Lum et al. | |
| 2012/0179137 | A1 | 7/2012 | Bartlett et al. | |
| 2012/0201726 | A1 | 8/2012 | Pearcy et al. | |
| 2013/0030412 | A1 | 1/2013 | Bartlett et al. | |
| 2013/0208558 | A1 | 8/2013 | Pearcy et al. | |
| 2014/0048556 | A1 | 2/2014 | Pearcy et al. | |
| 2014/0322102 | A1 | 10/2014 | Pearcy et al. | |
| 2015/0125364 | A1 | 5/2015 | Pearcy et al. | |

FOREIGN PATENT DOCUMENTS

| | | | |
|---|---|---|---|
| AU | 2015202242 | B2 | 11/2016 |
| CA | 2803375 | C | 5/2016 |
| CA | 2724339 | C | 8/2017 |
| CA | 2880981 | C | 8/2017 |
| DE | 19543240 | A1 | 5/1997 |
| EP | 1103304 | A2 | 5/2001 |
| EP | 2405961 | A2 | 1/2012 |
| EP | 2640526 | B1 | 9/2016 |
| EP | 2588404 | B1 | 3/2018 |
| JP | 2006271938 | A | 10/2006 |
| WO | WO-8603589 | A1 | 6/1986 |
| WO | WO-9103224 | A1 | 3/1991 |
| WO | WO-9210225 | A1 | 6/1992 |
| WO | WO-9517916 | A1 | 7/1995 |
| WO | WO-9630066 | A1 | 10/1996 |
| WO | WO-9703209 | A1 | 1/1997 |
| WO | WO-2009140502 | A1 | 11/2009 |
| WO | WO-2010104858 | A2 | 9/2010 |
| WO | WO-2011123762 | A1 | 10/2011 |
| WO | WO-2012006185 | A1 | 1/2012 |
| WO | WO-2012067619 | A1 | 5/2012 |
| WO | WO-2013043861 | A2 | 3/2013 |
| WO | WO-2013163598 | A2 | 10/2013 |
| WO | WO-2014004695 | A1 | 1/2014 |

OTHER PUBLICATIONS

U.S. Appl. No. 12/992,552 U.S. Pat. No. 8,940,539, filed Feb. 9, 2011, Reagent Preparation and Dispensing Device and Methods for the Same.

(56) References Cited

OTHER PUBLICATIONS

U.S. Appl. No. 13/450,365 U.S. Pat. No. 8,329,119, filed Apr. 18, 2012, Reagent Preparation and Dispensing Device and Methods for the Same.
U.S. Appl. No. 13/988,279 U.S. Pat. No. 8,919,390, filed Nov. 5, 2013, Reagent Preparation and Dispensing Device.
U.S. Appl. No. 14/331,431 U.S. Pat. No. 9,889,442, filed Jul. 15, 2014, Reagent Preparation and Dispensing Device.
U.S. Appl. No. 13/805,166 U.S. Pat. No. 8,973,749, filed Apr. 5, 2013, Reagent Preparation Assembly.
U.S. Appl. No. 14/597,677, filed Jan. 15, 2015, Reagent Preparation Assembly.
"U.S. Appl. No. 12/992,552, Examiner Interview Summary dated Jun. 11, 2013", 4 pgs.
"U.S. Appl. No. 12/992,552, Final Office Action dated Mar. 1, 2013", 21 pgs.
"U.S. Appl. No. 12/992,552, Non Final Office Action dated Aug. 2, 2012", 18 pgs.
"U.S. Appl. No. 12/992,552, Notice of Allowance dated Nov. 21, 2014", 7 pgs.
"U.S. Appl. No. 12/992,552, Preliminary Amendment filed Nov. 12, 2010", 6 pgs.
"U.S. Appl. No. 12/992,552, Response filed Jul. 1, 2013 to Final Office Action dated Jul. 1, 2013", 23 pgs.
"U.S. Appl. No. 12/992,552, Response filed Dec. 20, 2012 to Non Final Office Action dated Aug. 2, 2012", 22 pgs.
"U.S. Appl. No. 12/992,552, Supplemental Preliminary Amendment filed Dec. 13, 2010", 9 pgs.
"U.S. Appl. No. 13/450,365, Notice of Allowance dated Aug. 16, 2012", 13 pgs.
"U.S. Appl. No. 13/450,365, Preliminary Amendment filed Jul. 27, 2012", 12 pgs.
"U.S. Appl. No. 13/805,166, Notice of Allowability dated Jan. 23, 2015", 2 pgs.
"U.S. Appl. No. 13/805,166, Notice of Allowance dated Oct. 15, 2014", 8 pgs.
"U.S. Appl. No. 13/805,166, Preliminary Amendment filed Dec. 18, 2012", 8 pgs.
"U.S. Appl. No. 13/805,166, Response filed Sep. 25, 2014 to Restriction Requirement Jul. 22, 2014", 14 pgs.
"U.S. Appl. No. 13/805,166, Restriction Requirement dated Jul. 22, 2014", 8 pgs.
"U.S. Appl. No. 13/988,279, Notice of Allowability dated Nov. 21, 2014", 2 pgs.
"U.S. Appl. No. 13/988,279, Notice of Allowance dated Feb. 4, 2014", 9 pgs.
"U.S. Appl. No. 13/988,279, Notice of Allowance dated Apr. 1, 2014", 8 pgs.
"U.S. Appl. No. 13/988,279, Notice of Allowance dated Aug. 22, 2014", 8 pgs.
"U.S. Appl. No. 13/988,279, Preliminary Amendment filed May 17, 2013", 9 pgs.
"U.S. Appl. No. 13/988,279, PTO Response to Rule 312 Communication dated Jun. 30, 2014", 2 pgs.
"U.S. Appl. No. 14/331,431, Advisory Action dated Aug. 29, 2017", 3 pgs.
"U.S. Appl. No. 14/331,431, Corrected Notice of Allowance dated Jan. 11, 2018", 5 pgs.
"U.S. Appl. No. 14/331,431, Final Office Action dated Jul. 7, 2017", 8 pgs.
"U.S. Appl. No. 14/331,431, Non Final Office Action dated Dec. 20, 2016", 8 pgs.
"U.S. Appl. No. 14/331,431, Notice of Allowance dated Oct. 20, 2017", 8 pgs.
"U.S. Appl. No. 14/331,431, Preliminary Amendment filed Sep. 18, 2014", 9 pgs.
"U.S. Appl. No. 14/331,431, Response filed Aug. 11, 2017 to Final Office Action dated Aug. 11, 2017", 10 pgs.
"U.S. Appl. No. 14/331,431, Response filed Sep. 15, 2016 to Restriction Requirement dated Jul. 15, 2016", 15 pgs.
"U.S. Appl. No. 14/331,431, Response filed Mar. 20, 2017 to Non-Final Office Action dated Dec. 20, 2016", 11 pgs.
"U.S. Appl. No. 14/331,431, Restriction Requirement dated Jul. 15, 2016", 8 pgs.
"U.S. Appl. No. 14/597,677, Advisory Action dated Dec. 10, 2018", 4 pgs.
"U.S. Appl. No. 14/597,677, Ex Parte Quayle Action dated Jan. 7, 2019", 4 pgs.
"U.S. Appl. No. 14/597,677, Final Office Action dated Apr. 20, 2018", 7 pgs.
"U.S. Appl. No. 14/597,677, Non Final Office Action dated Nov. 27, 2017", 7 pgs.
"U.S. Appl. No. 14/597,677, Notice of Allowance dated Apr. 25, 2019", 7 pgs.
"U.S. Appl. No. 14/597,677, Pre-Appeal Brief filed Aug. 20, 2018", 5 pgs.
"U.S. Appl. No. 14/597,677, Preliminary Amendment filed Feb. 12, 2015", 6 pgs.
"U.S. Appl. No. 14/597,677, Response filed Mar. 7, 2019 to Ex Parte Quayle Action mailed Jan. 7, 2019", 7 pgs.
"U.S. Appl. No. 14/597,677, Response filed Mar. 27, 2018 to Non Final Office Action dated Nov. 27, 2017", 14 pgs.
"U.S. Appl. No. 14/597,677, Response filed Nov. 8, 2017 to Restriction Requirement dated Jul. 5, 2017", 8 pgs.
"U.S. Appl. No. 14/597,677, Response filed Nov. 21, 2018 to Final Office Action dated Apr. 20, 2018", 13 pgs.
"U.S. Appl. No. 14/597,677, Response filed Dec. 20, 2018 to Advisory Action dated Dec. 10, 2018", 13 pgs.
"U.S. Appl. No. 14/597,677, Restriction Requirement dated Jul. 5, 2017", 6 pgs.
"Australian Application Serial No. 2009246306, Office Action dated Mar. 13, 2014", 4 pgs.
"Australian Application Serial No. 2009246306, Response filed Sep. 1, 2014 to Office Action dated Mar. 13, 2014", 18 pgs.
"Australian Application Serial No. 2009246306, Voluntary Amendment filed Jan. 25, 2011", 42 pgs.
"Australian Application Serial No. 2010363976, Amendment filed Apr. 29, 2014", 17 pgs.
"Australian Application Serial No. 2010363976, First Examiners Report dated Jan. 7, 2015", 2 pgs.
"Australian Application Serial No. 2010363976, Office Action dated May 13, 2013", 2 pgs.
"Australian Application Serial No. 2010363976, Response filed May 22, 2013 to Office Action dated May 13, 2013", 58 pgs.
"Australian Application Serial No. 2010363976, Response filed Apr. 24, 2015 to First Examiners Report dated Jan. 7, 2015", 1 pg.
"Australian Application Serial No. 2011276396, Notice of Acceptance dated Apr. 24, 2014", 2 pgs.
"Australian Application Serial No. 2011276396, Office Action dated Dec. 11, 2013", 3 pgs.
"Australian Application Serial No. 2011276396, Response filed Apr. 10, 2014 to Office Action dated Dec. 11, 2013", 19 pgs.
"Australian Application Serial No. 2011276396, Voluntary Amendment filed Dec. 17, 2012", 14 pgs.
"Australian Application Serial No. 2014280969, Non Final Office Action dated Jan. 12, 2015", 2 pgs.
"Australian Application Serial No. 2015202242, First Examiner Report dated May 10, 2016", 3 pgs.
"Australian Application Serial No. 2015202242, Response filed Sep. 21, 2016 to First Examiner Report dated May 10, 2016", 26 pgs.
"Canadian Apllication Serial No. 2,803,375 Response filed Nov. 25, 2014 to Non Final Office Action dated Jun. 5, 2014", 3 Pgs.
"Canadian Application Serial No. 2,724,339, Office Action dated Jun 11, 2015", 5 pgs.
"Canadian Application Serial No. 2,724,339, Response filed Dec. 11, 2015 to Office Action dated Jun. 11, 2015", (English Translation of Claims), 319 pgs.
"Canadian Application Serial No. 2,803,375, Office Action dated Jun. 5, 2014", 2 pgs.
"Canadian Application Serial No. 2,880,981, Office Action dated Mar. 8, 2016", 4 pgs.

(56) References Cited

OTHER PUBLICATIONS

"Canadian Application Serial No. 2,880,981, Response filed Sep. 7, 2016 to Office Action dated Mar. 8, 2016", 13 pgs.
"European Application Serial No. 09747584.2, Communication Pursuant to Article 94(3) EPC dated Jul. 5, 2016", 7 pgs.
"European Application Serial No. 09747584.2, Communication Pursuant to Article 94(3) EPC dated Nov. 28, 2018", 5 pgs.
"European Application Serial No. 09747584.2, Response filed Nov. 15, 2016 to Communication Pursuant to Article 94(3) EPC dated Jul. 5, 2016", 16 pgs.
"European Application Serial No. 10859869.9, Examination Notification Art. 94(3) dated Jun. 23, 2015", 4 pgs.
"European Application Serial No. 10859869.9, Extended European Search Report dated May 20, 2014", 7 pgs.
"European Application Serial No. 10859869.9, Office Action dated Jul. 5, 2013", 2 pgs.
"European Application Serial No. 10859869.9, Response filed Jul. 19, 2013 to Office Action dated Jul. 5, 2013", 54 pgs.
"European Application Serial No. 10859869.9, Response filed Dec. 1, 2014 to Extended European Search Report dated May 20, 2014", 26 pgs.
"European Application Serial No. 10859869.9, Response filed Dec. 14, 2015 to Examination Notification Art. 94(3) dated Jun. 23, 2015", 17 pgs.
"European Application Serial No. 11804202.7, Communication Pursuant to Artilce 94(3) and Rule 71(1) EPC dated Mar. 16, 2017", 5 pgs.
"European Application Serial No. 11804202.7, Extended European Search Report dated Jul. 7, 2014", 6 pgs.
"European Application Serial No. 11804202.7, Office Action dated Apr. 10, 2013", 2 pgs.
"European Application Serial No. 11804202.7, Response filed Feb. 3, 2015 to Extended European Search Report dated Jul. 7, 2014", 14 pgs.
"European Application Serial No. 16190922.1, Communication Pursuant to Article 94(3) EPC dated Apr. 12, 2019", 5 pgs.
"European Application Serial No. 16190922.1, Extended European Search Report dated Mar. 1, 2017", 7 pgs.
"European Application Serial No. 16190922.1, Response filed Sep. 29, 2017 to Extended European Search Report dated Mar. 1, 2017", 18 pgs.
"European Application Serial No. 9747584.2, Communication Pursuant to Article 94(3) EPC dated Feb. 20, 2017", 7 pgs.
"European Application Serial No. 9747584.2, Response filed Aug. 30, 2017 to Communication Pursuant to Article 94(3) EPC dated Feb. 20, 2017", 28 pgs.
"International Application Serial No. PCT/US2009/043966, Demand and Response filed Mar. 12, 2010 to Written Opinion dated Jul. 31, 2009", 36 pgs.
"International Application Serial No. PCT/US2009/043966, International Preliminary Report on Patentability dated Jul. 27, 2011", 36 pgs.
"International Application Serial No. PCT/US2009/043966, Search Report dated Jul. 27, 2009", 7 pgs.
"International Application Serial No. PCT/US2009/043966, Written Opinion dated Jul. 27, 2009", 6 pgs.
"International Application Serial No. PCT/US2010/057238, Response to Written Opinion filed Sep. 18, 2012", 14 pgs.
"International Application Serial No. PCT/US2010/057238, International Preliminary Report on Patentability dated Dec. 14, 2012", 41 pgs.
"International Application Serial No. PCT/US2010/057238, International Search Report dated Jan. 26, 2011", 2 pgs.
"International Application Serial No. PCT/US2010/057238, Written Opinion dated Jan. 26, 2011",9 pgs.
"International Application Serial No. PCT/US2011/042443, International Preliminary Report on Patentability dated Jul. 31, 2012", 29 pgs.
"International Application Serial No. PCT/US2011/042443, International Search Report dated Nov. 25, 2011", 2 pgs.
"International Application Serial No. PCT/US2011/042443, Response filed Apr. 27, 2012 to Written Opinion dated Nov. 25, 2011", 11 pgs.
"International Application Serial No. PCT/US2011/042443, Written Opinion dated Nov. 25, 2011", 4 pgs.
"European Application Serial No. 16190922.1, Response filed Oct. 16, 2019 to Communication Pursuant to Article 94(3) EPC dated Apr. 12, 2019", 16 pgs.

* cited by examiner

REAGENT PREPARATION ASSEMBLY

RELATED MATTERS

This patent application is a continuation of U.S. patent application Ser. No. 14/597,677, filed on Jan. 15, 2015, which is a continuation of U.S. patent application Ser. No. 13/805,166, filed on Apr. 5, 2013 which is a national stage application under 35 U.S.C. § 371 of PCT/US2011/042443, filed Jun. 29, 2011, and published as WO 2012/006185 A1 on Jan. 12, 2012, which claims priority benefit of U.S. Provisional Patent Application Ser. No. 61/359,636 filed Jun. 29, 2010, which applications and publication are incorporated by reference as if reproduced herein and made a part hereof in their entirety, and the benefit of priority of each of which is claimed herein.

TECHNICAL FIELD

Storage, preparation and dispensing of solutions.

BACKGROUND

Some examples of diagnostic and drug discovery reagents require preparation prior to use. For instance, reagents may require measuring a solution and using the solution to rehydrate dry reagent. In other examples, preparation of the reagent requires measuring and mixing of a sample solution with a reagent in a dried or liquid form. In still other examples, preparation of the reagent requires mixing of two or more liquid components, such as a reagent and a solution.

Manufacturers of diagnostic and drug discovery reagents use precision and standardized procedures in order to produce high quality reagents. These reagents are then prepared at their point of use. The quality of the reagents (e.g., the precise amount of reagent solution, the purity of the reagent solution and the like) is easily compromised at the point of use because of errors in preparation procedures that are used by personnel responsible for preparing the reagent. For instance, the reagent is handled in an unclean environment having contaminants (e.g., humid atmosphere, biologically active environment, chemically active environment, and the like), the wrong amount of solution is used, the wrong solution is used, and the like. In other examples, the reagent and solution are not allowed to mix thoroughly. In still other examples, the reagent solution is dispensed from a device but fails to deliver the full specified amount of reagent solution as a result of operator error or device performance (e.g., a portion of the solution is left within the device, more or less than a single aliquot of solutions is formed).

Where lyophilized reagents (e.g., dried or freeze-dried reagents) are used, unwanted exposure to contaminants including, but not limited to, moisture or moisture vapor during storage and prior to reconstitution may contaminate or compromise the stability of the lyophilized reagent. Compromising the reagent decreases its ability to rapidly rehydrate thereby creating difficulties in preparing a reagent at the proper concentration.

Even small errors in preparation leading to an improperly prepared reagent may have undesirable consequences, including, but not limited to, false positives, inaccurate diagnoses leading to inaccurate or inappropriate treatments, and false negatives (undetected diagnoses resulting in no treatment where treatment is needed).

BRIEF DESCRIPTION OF THE DRAWINGS

A more complete understanding of the present subject matter may be derived by referring to the detailed description and claims when considered in connection with the following illustrative Figures. In the following Figures, like reference numbers refer to similar elements and steps throughout the Figures.

Elements and steps in the Figures are illustrated for simplicity and clarity and have not necessarily been rendered according to any particular sequence. For example, steps that may be performed concurrently or in different order are illustrated in the Figures to help to improve understanding of examples of the present subject matter.

DESCRIPTION OF THE DRAWINGS

In the following detailed description, reference is made to the accompanying drawings which form a part hereof, and in which is shown by way of illustration specific examples in which the subject matter may be practiced. These examples are described in sufficient detail to enable those skilled in the art to practice the subject matter, and it is to be understood that other examples may be utilized and that structural changes may be made without departing from the scope of the present subject matter. Therefore, the following detailed description is not to be taken in a limiting sense, and the scope of the present subject matter is defined by the appended claims and their equivalents.

While the devices and methods presented in the detailed description describe devices for non-therapeutic uses, non-pharmaceutical uses and the like, the devices and methods are applicable to at least some pharmaceutical applications that do not require administration to a subject by injection with a syringe needle. It is also within the scope of the devices and methods described herein that a syringe needle and medicaments are usable with the same. For instance, the access port includes a self-sealing septum. Additionally, the reagents described below include, but are not limited to, lyophilized reagents, liquid reagents, powder reagents and the like. Further, the solutions described below include, but are not limited to, liquid solutions such as, saline, distilled water, tap water, pH buffered water, chemical solutions capable of breaking down the reagents and the like. In another example, the solutions include, but are not limited to, biological or environmental samples in a liquid form or suspended within a liquid, such as blood, urine, fecal matter, saliva, perspiration, soil, ground water, fresh water, salt water, explosives, explosive residues, toxins and the like.

Figure 1A:
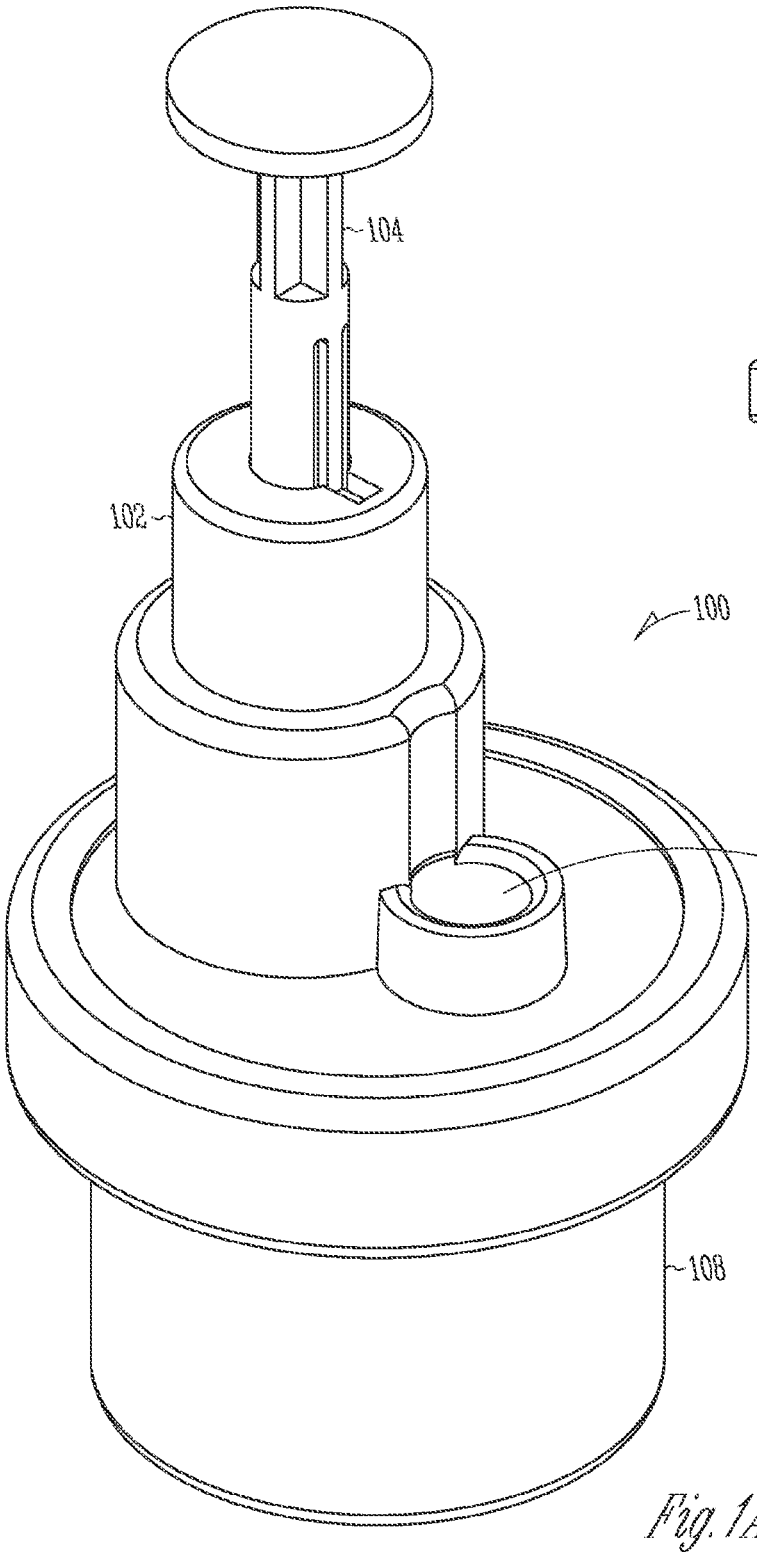
FIG. 1A is a perspective view showing one example of a reagent preparation assembly.
Figure 1B:
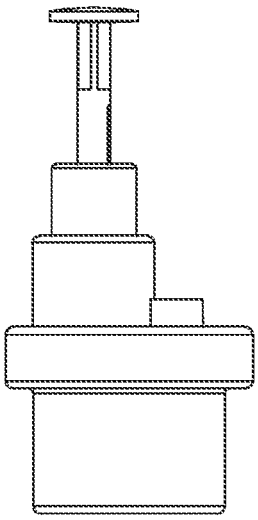
FIG. 1B is a side view of the reagent preparation assembly shown in FIG. 1A.

FIGS. 1A, B show one example of a reagent preparation assembly 100 configured for reconstitution of a reagent into a specified amount of a reagent mixture. The assembly 100 includes, as shown in FIGS. 1A, B, a body 102 moveably coupled with a plunger 104. A cap 108 is secured with the body 102 and assists in providing a dry environment for the reagent contained within the body 102. An access port 106 is formed within the body 102 to provide access to an instrument, such as a pipette for drawing of the reagent mixture formed within the body 102 into the instrument. The reagent preparation assembly 100 is constructed with, but not limited to, a variety of materials including plastics, metals, composites and the like. In some examples, where seals are formed between various components of the reagent preparation assembly 100, seals include, but are not limited to, elastomers, such a butyl rubber, foils, membranes, semi-permeable membranes including, for instance, hydrophobic, hydrophilic, lyophobic, lipophilic materials and the like.

Figure 2:
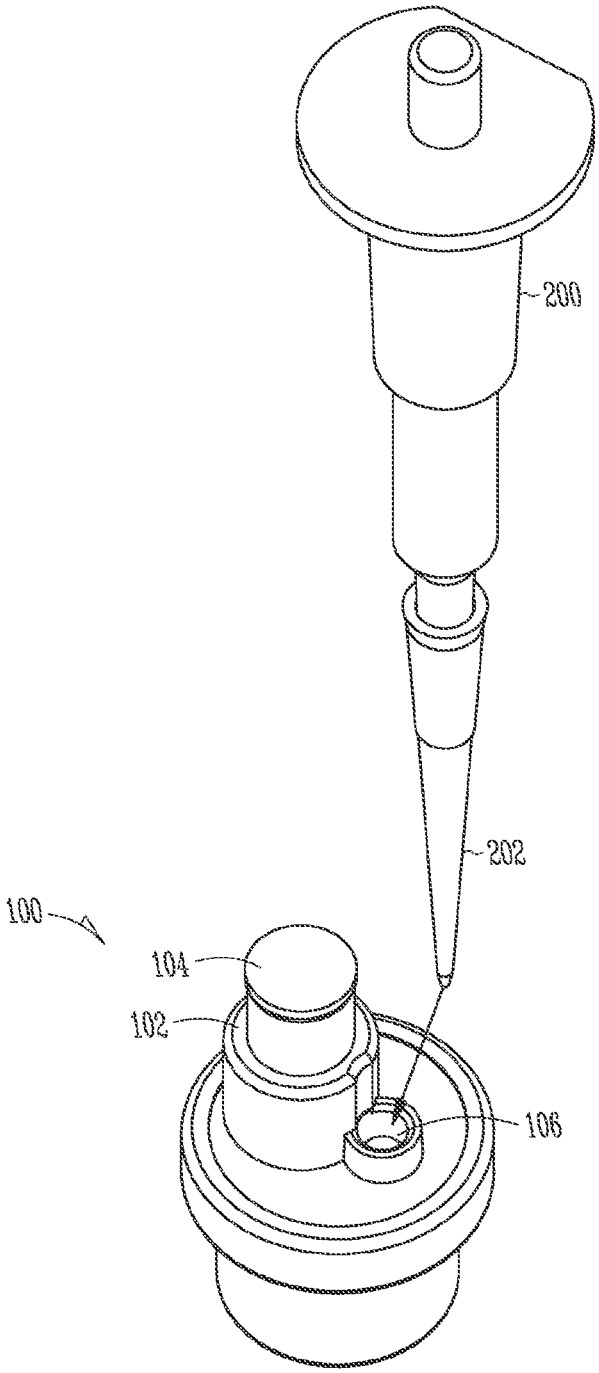
FIG. 2 is a perspective view of the reagent preparation assembly of FIG. 1A in a configuration where a reagent is reconstituted. A pipette is shown with the assembly.
Figure 3:
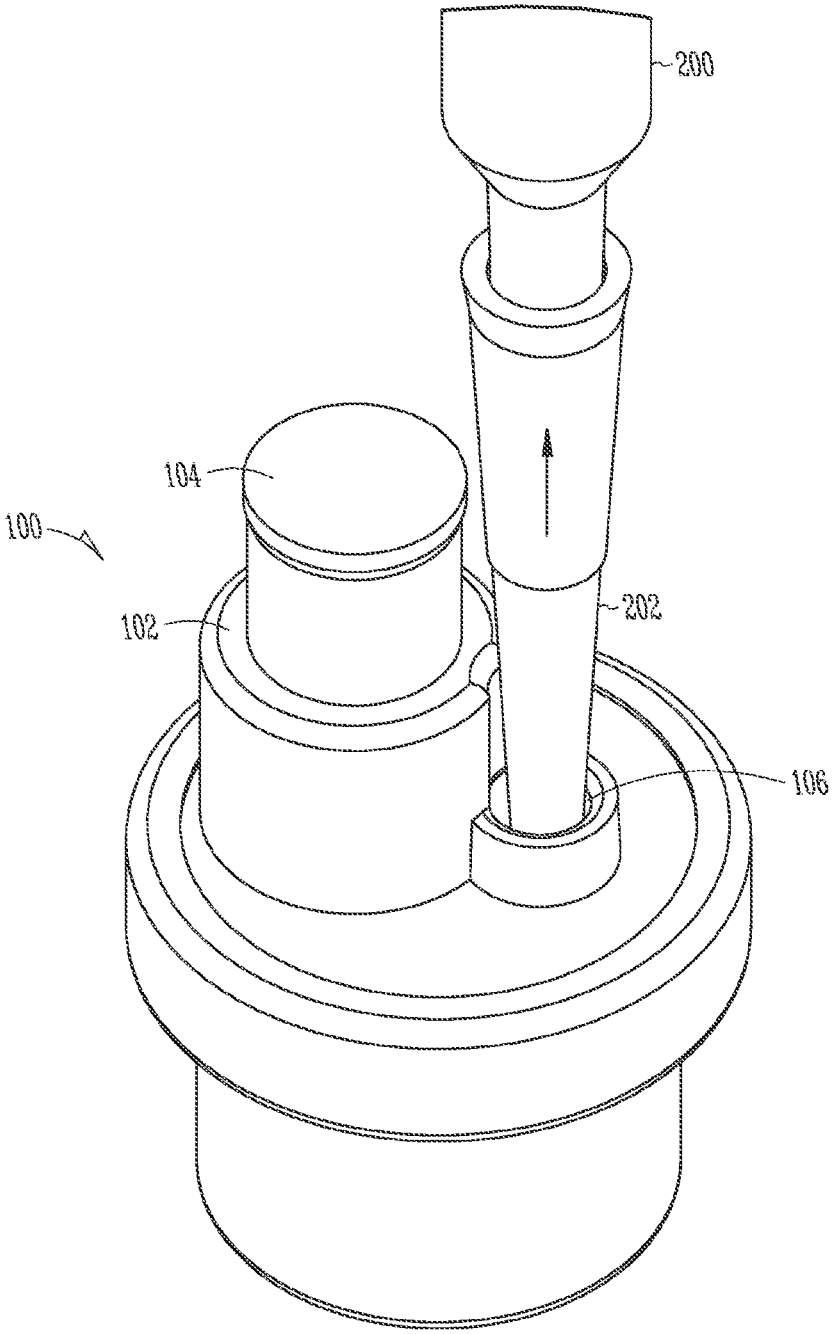
FIG. 3 is a perspective view of the reagent preparation assembly of FIG. 2 with the pipette positioned within an access port.

Referring now to FIG. 2, the reagent preparation assembly 100 is shown in a reconstituted configuration where the plunger 104 is fully depressed relative to the body 102. The reagent within the body 102 is reconstituted with a solution housed within the body 102. A pipette 200 including a pipette tip 202 is shown disposed above the reagent preparation assembly 100. As shown in FIG. 3, the pipette tip 202 is positioned through the access port 106 into a reaction chamber within the body 102. As will be described in further detail below, the assembly 100 includes a well, such as a tapered well, within the reaction chamber to position the reagent mixture beneath the access port 106. The pipette 200 is thereafter used to draw the reagent mixture into the pipette for use in the diagnostic therapeutic or other procedure.

Figure 4A:
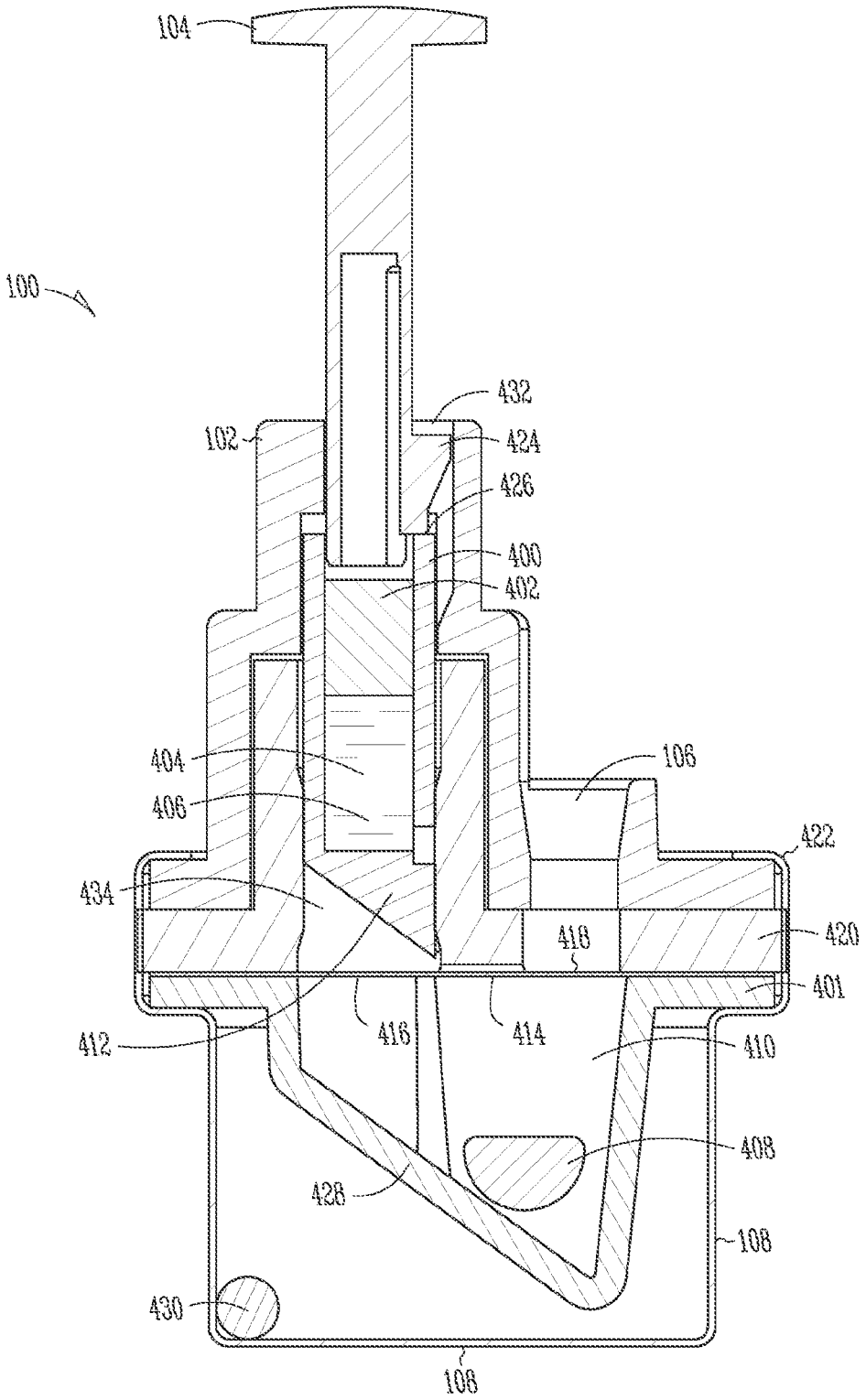
FIG. 4A is a cross sectional view of the reagent preparation assembly shown in FIG. 1A.
Figure 4B:
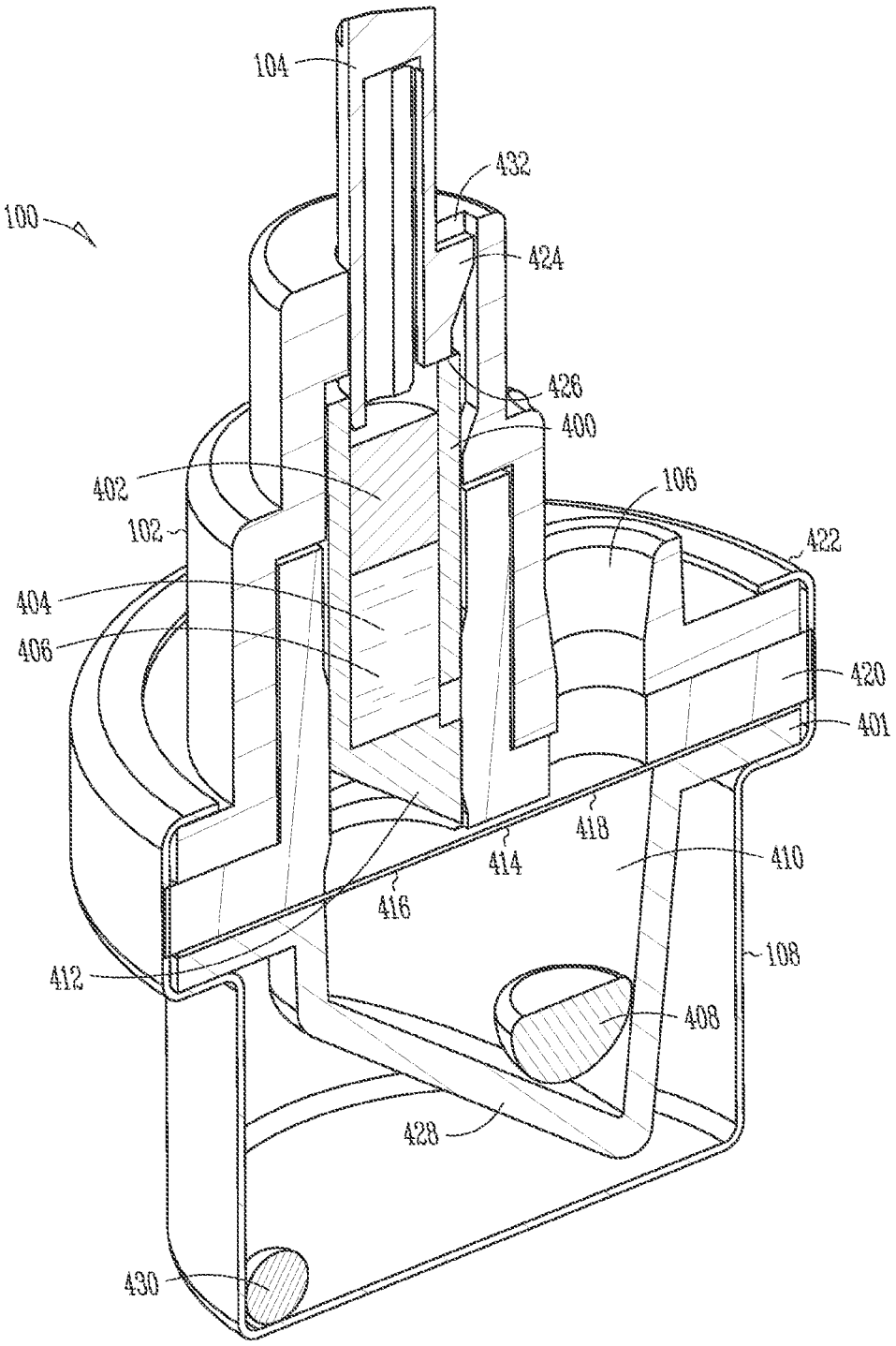
FIG. 4B is a detailed cross sectional view of the reagent preparation assembly shown in FIG. 4A.
Figure 4C:
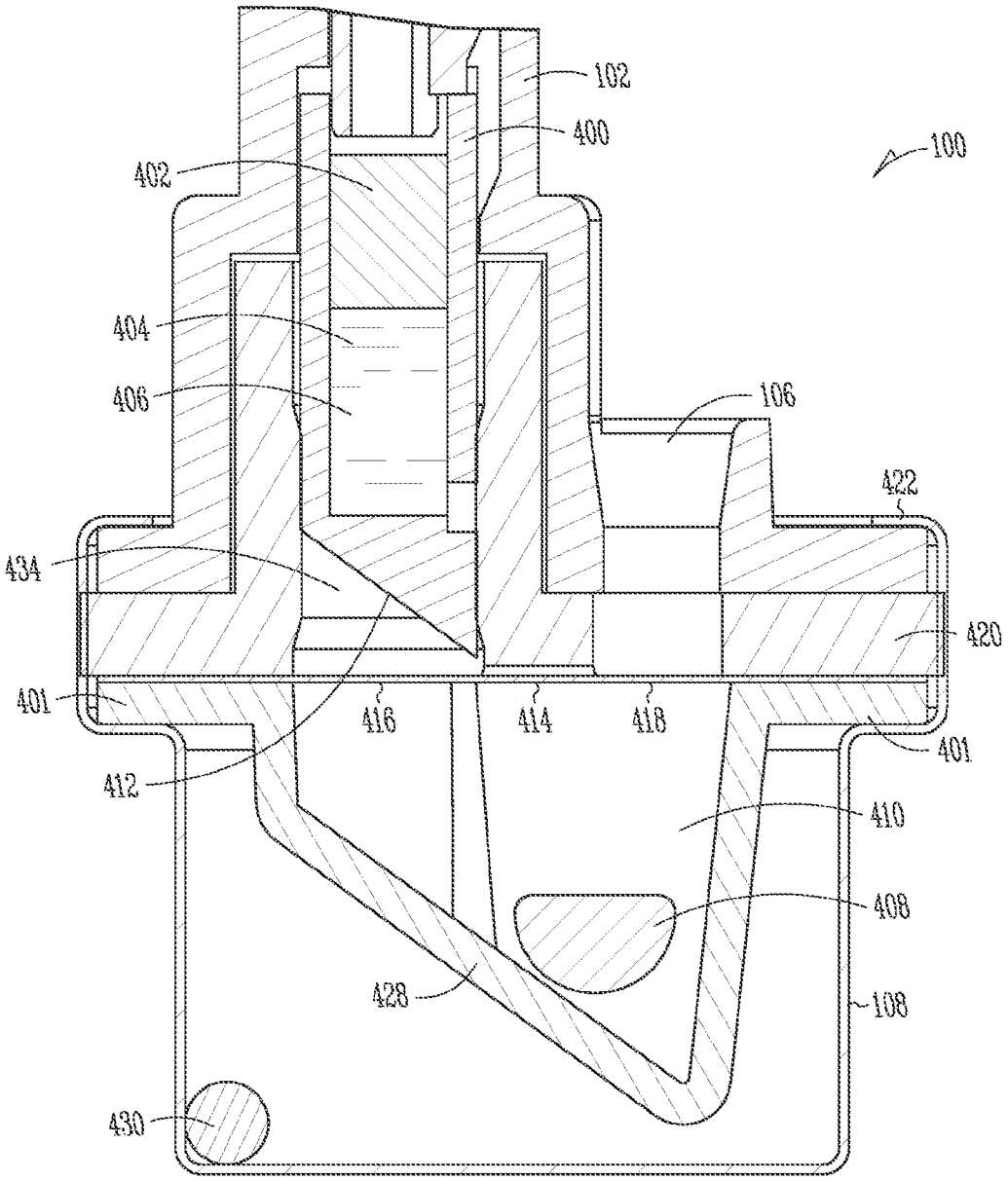
FIG. 4C is a detailed cross sectional view of the reagent preparation assembly shown in FIG. 4A.

Referring now to FIG. 4A, the reagent preparation assembly 100 is shown in cross-section. As previously described, the plunger 104 is movably coupled with the body 102. The plunger 402, in one example, includes a tongue 424 slidably engaged along an inner portion of the body 102. The tongue 424 is positioned within a tongue slot 432 formed in the body 102. The tongue 424 is configured to selectively engage with a syringe 400 and a piston 402 within the body 102. Stated another way, the plunger 104 (including the tongue 424) is engaged with the piston 402 and is integral or separate from the piston 402, and the plunger in either arrangement moves the piston within the body 102 and the syringe 400 after, for instance, the tongue 424 is deflected as described herein. Referring to FIGS. 4A-C, the syringe 400 is shown movably coupled within the body 102. For instance, the syringe 400 is housed within a syringe passage 434 extending through a portion of the body 102 as well as a gasket 420. In one example, the gasket 420 slidably couples with the syringe 400 and a seal is formed between the syringe 400 and the gasket 420 to ensure atmosphere exterior to the reagent preparation assembly 100 is unable to reach the reaction chamber 410 positioned beneath the syringe 400. Additionally, sealing of the gasket 420 around the syringe 400 ensures that the solution 406 contained within a solution reservoir 404 of the syringe is fully dispensed into the reaction chamber 410 without unintended passage of the solution (or the reagent mixture) around the syringe and out of the reagent preparation assembly 100.

The reagent preparation assembly 100 includes the reaction chamber 410 positioned beneath the body 102. In one example, the body 102 includes the structural housing of the assembly 100 including the reaction chamber 410. The gasket 420 is interposed between the body 102 and the reaction chamber 410. In one example, the cap 108 is crimped at a crimp 422 around the body 102, gasket 420 and the reaction chamber 410. The crimp 422 tightly engages the body, gasket and the reaction chamber 410 and substantially prevents the ingress of moisture and atmosphere into the reaction chamber 410 containing a reagent 408. In another example a desiccant 430 is held within the cap 108 to absorb moisture within the cap.

In the example shown in FIGS. 4A-C, a seal membrane 414 is further coupled between the gasket 420 and the reaction chamber 410. For instance, as shown in FIGS. 4A and 4B, the seal membrane 414 is coupled between the gasket 420 and a flange extending around the perimeter of the reaction chamber 410. The flange is shown in FIGS. 4A, 4B and 4C as feature 401. The seal membrane 414, in the example shown, includes a syringe seal 416 and an access seal 418 positioned across the respective syringe passage 434 and access port 106. As will be described in further detail below, the syringe seal 416 and the access seal 418 allow for selective piercing of the seal membrane 414 during the reconstitution process using the reagent preparation assembly 100. Optionally, the assembly 100 includes separate seals for each of the syringe seal 416 and the access seal 418. In another option, the access seal 418 includes, but is not limited to, a plug, self-sealing septum and the like.

Referring again to the reaction chamber 410, in the example shown in FIGS. 4A-C, the reaction chamber includes a bevel edge 428. The reagent 408 is shown positioned near the bottom of the beveled edge 428. The beveled edge 428, in one example, is configured to taper toward the area substantially or directly beneath the access port 106. As will be shown in further detail below, tapering the beveled edge 428 toward the area beneath the access port ensures the reconstituted reagent (e.g., a reagent mixture) settles at the bottom of the reaction chamber 410 directly beneath the access port 106. The tapered edge 428 in the reaction chamber 410 forms a well for a reconstituted reagent mixture beneath the access port 106. An instrument such as a pipette positioned within the access port 106 is thereby able to withdraw the full amount of the reagent mixture within the reaction chamber 410 as the reagent mixture pools directly beneath the access port 106 in a well.

Referring now to FIG. 4C, a piercing edge 412 of the syringe 400 is shown positioned above the syringe seal 416. As will be described in further detail below, the piercing edge 412 is sized and shaped to engage with and pierce the syringe seal 416 to provide communication between the solution reservoir 404 and the reaction chamber 410 for reconstitution of the reagent 408.

Figure 5A:
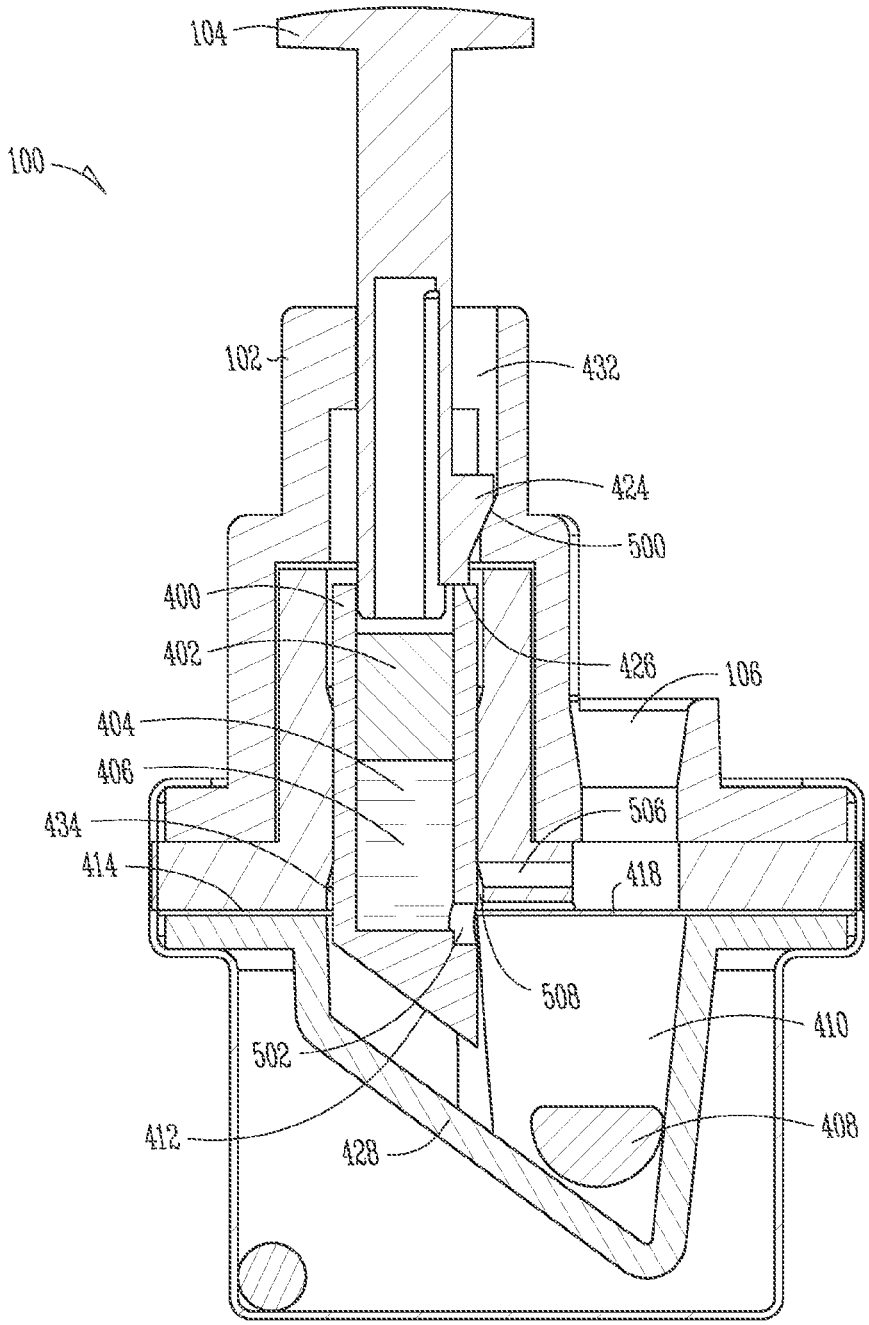
FIG. 5A is a cross sectional view of the reagent preparation assembly shown in FIG. 1A in a first intermediate configuration.
Figure 5B:
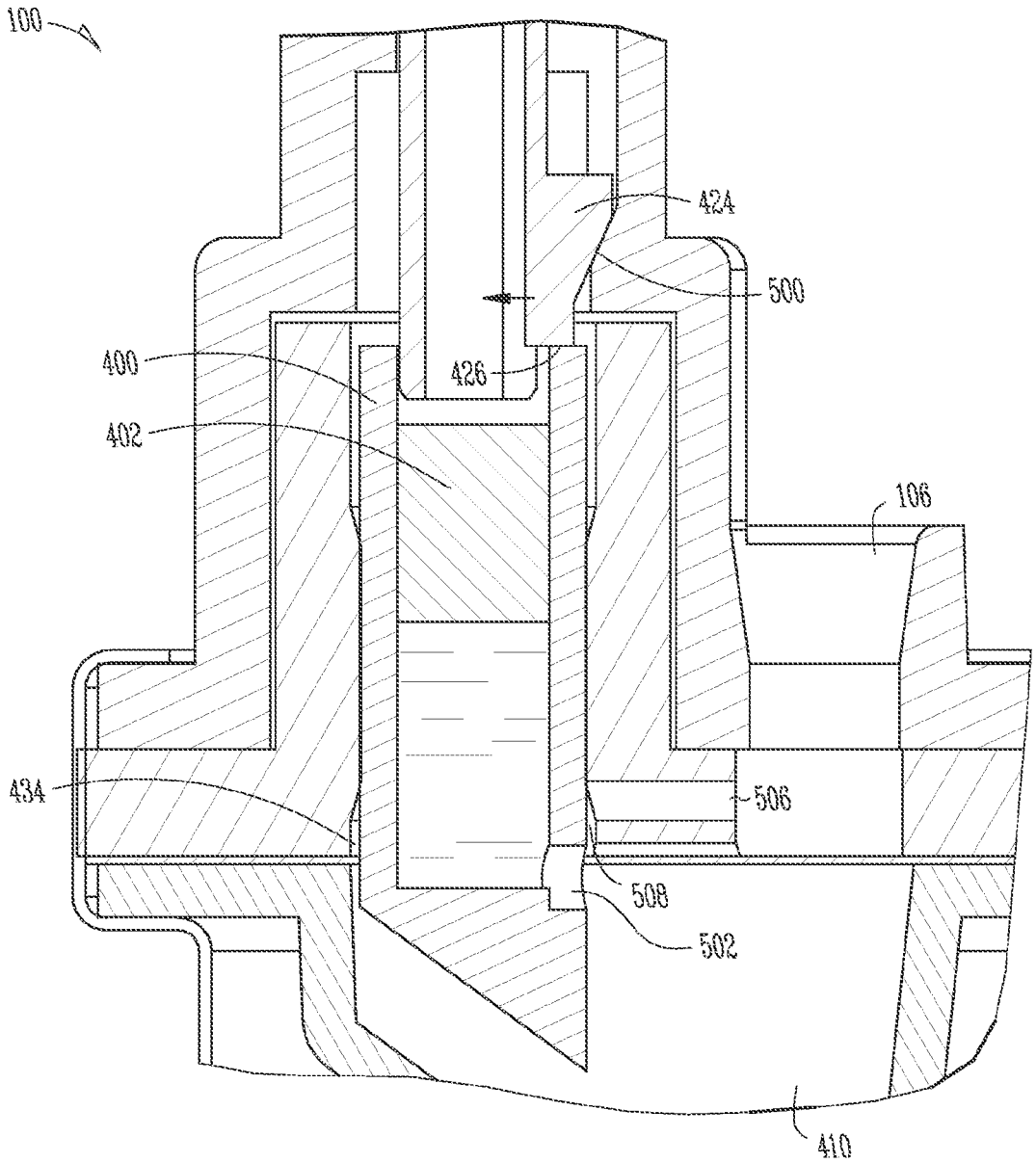
FIG. 5B is a detailed cross sectional view of the reagent preparation assembly shown in FIG. 5A.

As shown in FIG. 5A, the plunger 104 is partially depressed relative to the body 102. The plunger 104 is engaged with a syringe end surface 426 through engagement of the tongue 424. Stated another way, the tongue 424 of the plunger 104 is engaged with the syringe end surface 426 and depression of the plunger 104 correspondingly moves the syringe 400 into and through the syringe seal 416 and exposes a syringe orifice 502 to the reaction chamber 410. Further, the tongue 424 engages against a cam surface 500 formed in the body 102. As will be described in further detail, engagement of the tongue 424 with the cam surface 500 deflects the tongue inwardly to disengage the tongue 424 from the syringe end surface 426. Referring to FIG. 5B, the syringe end surface 426, the cam surface 500 and the tongue 424 are shown in detail. As the cam surface 500 slides along the tongue 424, the tongue 424 deflects inwardly as shown by the arrow in FIG. 5B. While the tongue 424 is engaged with the syringe end surface 426 the plunger 104 is unable to engage with the piston 402. The solution 406 contained within the solution reservoir 404 is thereby retained within the syringe 400 after the syringe 400 is punctured through the seal membrane 414.

In the example shown in FIGS. 5A and 5B, the gasket 420, in one example, includes a vent path 506 extending from the syringe passage 434 into the access port 106. The vent path 506 allows for gasses within the reaction chamber 410 to vent from the syringe passage 434 through the vent path 506 and finally out of the access port 106 (e.g., to the exterior of the assembly 100). As shown in FIGS. 5A and 5B, the access seal 418 remains positioned over the access port 506 until punctured by an instrument. Referring to FIG. 5B, a vent recess 508 is formed in the gasket 420 facilitating passage of fluids such as gasses within the reaction chamber 410 through the vent path 506. Stated another way, as the syringe 400 moves into the reaction chamber 410 fluids within the reaction chamber 410, such as gasses are displaced by the movement of the syringe 400. These gasses travel through the vent recess 508 and the vent path 506 to exit the reaction chamber 410 through the access port 106. Over pressures and the like are thereby equalized within the reaction chamber 410 through the vent path 506. As will be described in further detail below, the vent path 506 remains open throughout the reconstitution process and further facilitates the venting of gasses displaced by the introduction of the solution 406 to the reaction chamber 410 through movement of the piston 402. Optionally, a semi-permeable membrane is positioned along the vent path 506 to prevent the passage of the reagent mixture or solution through the vent path. For instance a hydrophobic membrane is positioned across the vent path 506 to prevent the passage of saline or a reagent mixture formed with saline. In another example, the vent path 506 is instead formed as a recess between the seal membrane 414 and the gasket 420 (as shown for instance, in FIGS. 5A-C and other figures).

Figure 6:
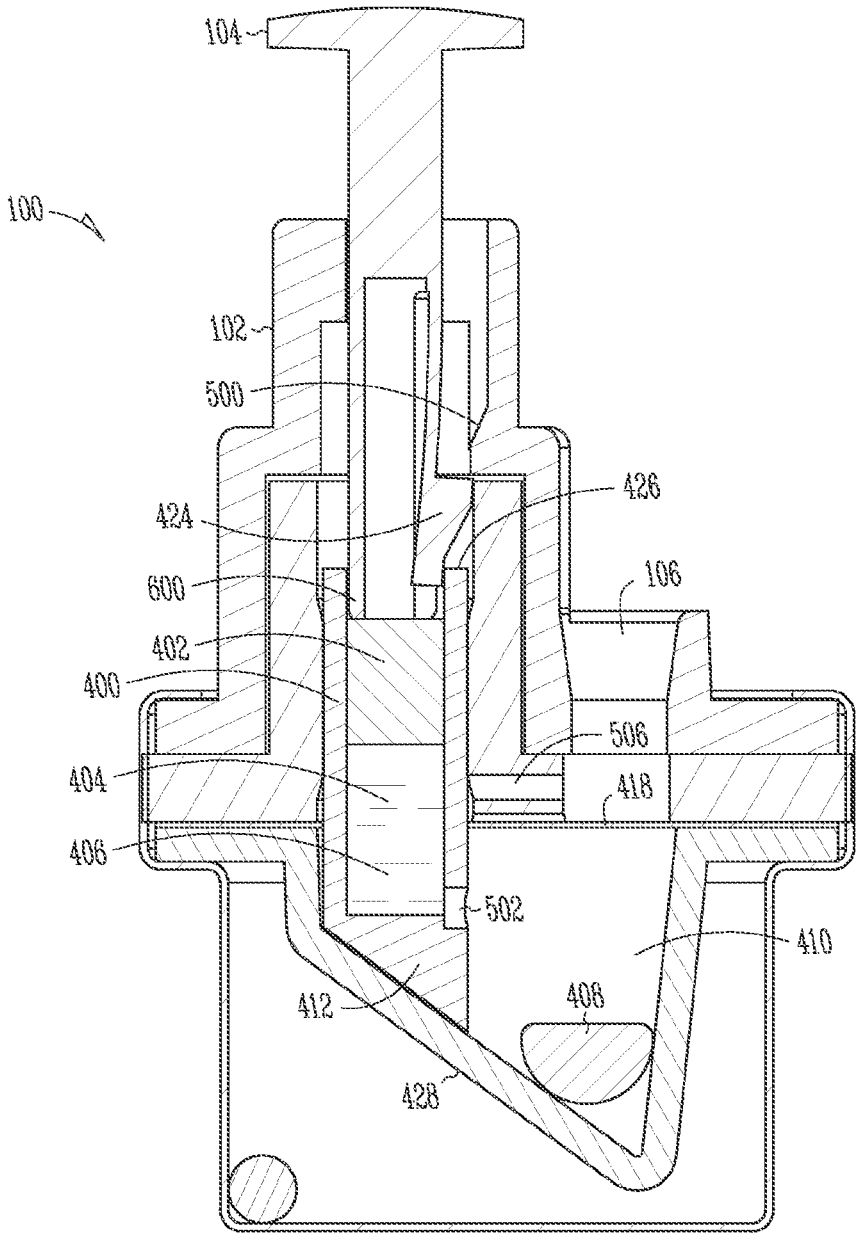
FIG. 6 is a cross sectional view of the reagent preparation assembly shown in FIG. 1A in a second intermediate configuration.

Referring now to FIG. 6, the reagent preparation assembly 100 is shown in a configuration with the syringe 400 in a fully depressed orientation relative to the body 102 and the reaction chamber 410. As shown in FIG. 6, the piercing edge 412 is seated along the beveled edge 428 of the reaction chamber 410. In one example, the piercing edge 412 and the beveled edge 428 have corresponding shapes allowing for the piercing edge 412 to snuggly engage along the beveled edge 428. With the plunger 104 in the position shown in FIG. 6 the tongue 424 has fully moved over the cam surface 500 previously shown in FIGS. 5A and 5B. As previously discussed, movement of the tongue 424 over the cam surface 500 deflects the tongue 424 out of engagement with the syringe end surface 426. Continued movement of the plunger 104 as shown in FIG. 6 engages a plunger post 600 with the piston 402. As will be described and shown in later Figures, continued movement of the plunger 104 relative to the body 102 moves the piston 102 through the syringe 400 and pushes the solution 406 out of the solution reservoir 404 into the reaction chamber 410. Once in the configuration shown in FIG. 6, the tongue 424 remains disengaged with the syringe end surface 426 to facilitate continued movement of the plunger 104 relative to the syringe 400.

Figure 7:
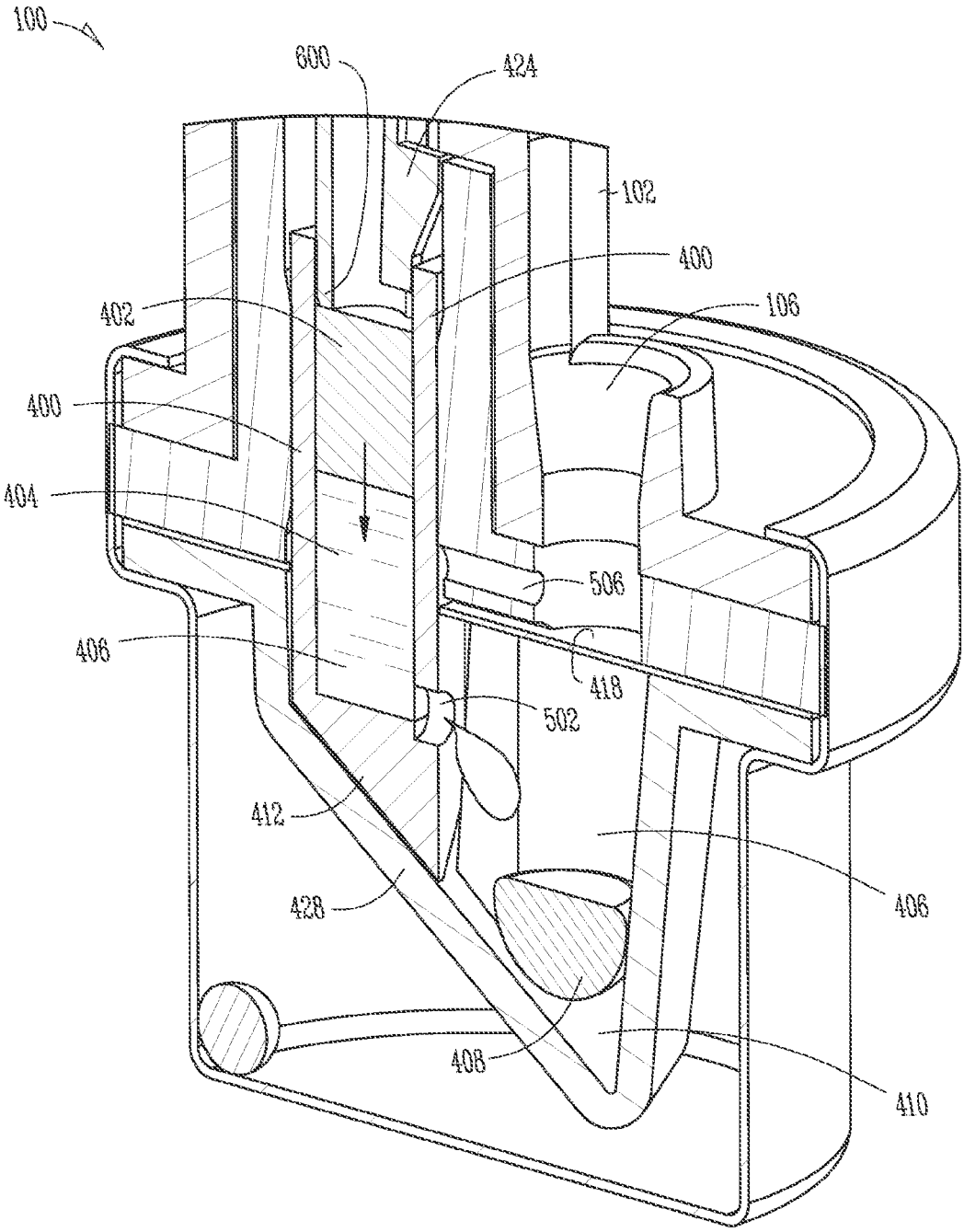
FIG. 7 is a cross sectional view of the reagent preparation assembly shown in FIG. 1A in a third intermediate configuration.

Referring now to FIG. 7, the reagent preparation assembly 100 is shown in another intermediate configuration with the plunger 104 (see FIG. 6) further depressed relative to the body 102. As previously described, depression of the plunger 104 relative to the body 102 moves the piston 402 (engaged with the plunger post 600) relative to the syringe 400. Movement of the piston 402 forces the solution 406 (e.g., saline or another solution configured to reconstitute a reagent) out of the solution reservoir 404 and into the reaction chamber 410. As shown in FIG. 7, the solution 406 travels through the syringe orifice 502 extending through a portion of the syringe 400. The solution 406 washes over the reagent 408 to form a reagent mixture within the reagent reservoir 410.

As shown, the syringe 400 fills a portion of the reaction chamber 410 thereby limiting the space devoted to reconstitution of the reagent 408 with the solution 406. Reconstitution is thereby localized within a well of the reaction chamber 410 directly or substantially underlying the access port 106 to facilitate easy drawing of the reagent mixture into an instrument such as a pipette when positioned within the access port 106. The tapered surface 428 (e.g., beveled edge) further diverts the reagent mixture to the well portion of the reaction chamber 410 to retain the mixture until withdrawn by an instrument.

As previously described, as the piston 402 moves the solution 406 into the reaction chamber 410 gas is displaced from the reaction chamber 410. The gas travels through the vent path 506 and out the access port 106 (e.g., exterior to the assembly 100) to equalize pressure within the reaction chamber 410 and thereby substantially prevent any likelihood of premature opening of the access seal 418. Optionally, the reagent preparation assembly 100 is without a vent path 506 and pressure is allowed to build up within the reaction chamber 410. In one example, where the assembly 100 is without a vent path 506 the overpressure is minimal and not strong enough to break the access seal 418. In yet another example, a hydrophobic membrane elsewhere on the reaction chamber 410 or body 102 allows for the passage of gas from the reaction chamber and prevents the passage of the solution or reagent mixture.

Figure 8A:
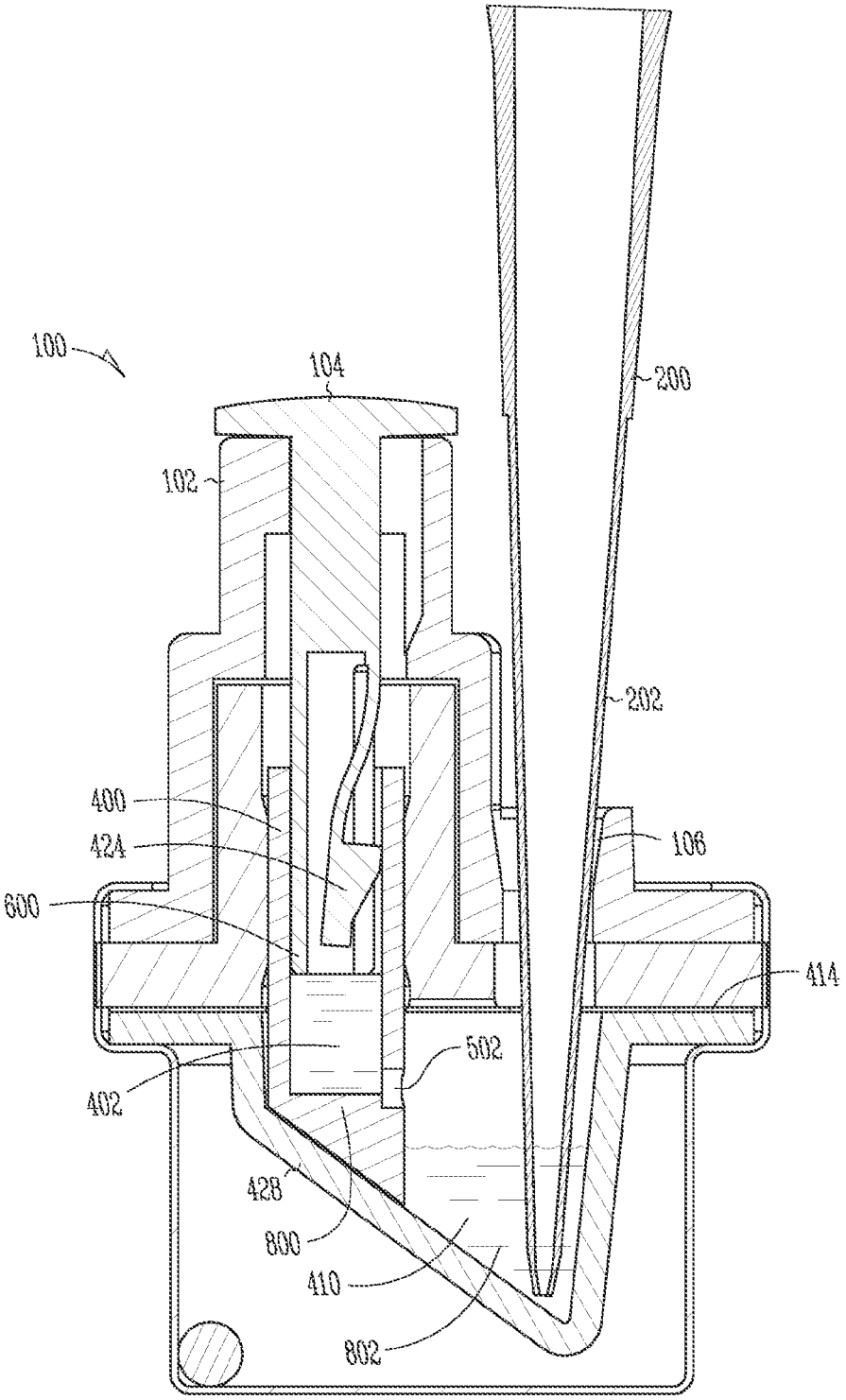
FIG. 8A is a cross sectional view of the reagent preparation assembly shown in FIG. 1A in a configuration with the reagent reconstituted and an instrument is positioned within an access port.
Figure 8B:
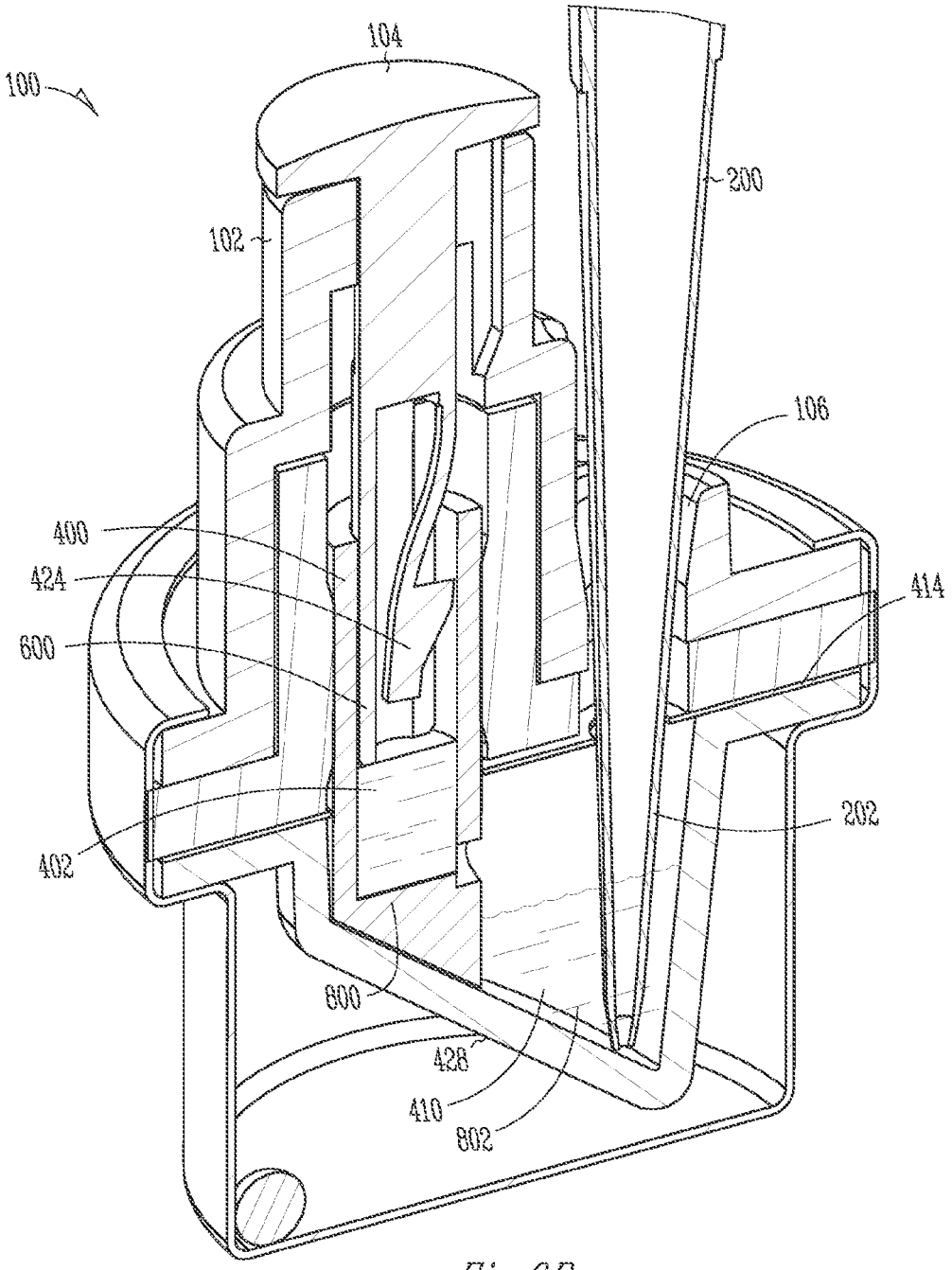
FIG. 8B is a detailed cross sectional view of the reagent preparation assembly shown in FIG. 8A.

FIG. 8A shows the reagent preparation assembly 100 in a final reconstituted configuration where the plunger 104 is fully depressed relative to the body 102 and a reagent mixture 802 is reconstituted and formed within the reaction chamber 410. As shown in FIGS. 8A and 8B, the piston 402 is fully moved through the solution reservoir 404 previously shown in FIGS. 4A-C. The plunger post 600 has moved the piston 402 into engagement with the reservoir base 800 of the syringe 400. The tongue 424 is formed on a deflectable arm as shown in previous figures and depression of the plunger 104 deflects the tongue 424 into an interior portion of the syringe as the plunger is advanced over the syringe 400. That is to say, the tongue 424 is positioned within the interior of a surface of the syringe 400 forming the solution reservoir 404. Once the reagent 408 is reconstituted within the reaction chamber 410 the reagent mixture 802 is formed. In one example, the reagent 408 includes a specified concentration to mix with the corresponding specified amount of solution to form a volume of reagent mixture 802 having a predetermined concentration. As shown in FIGS. 8A and 8B, an instrument such as a pipette 200, pierces the access seal 418 previously shown in FIGS. 4A-C. The pipette tip 202 is shown positioned partially within the reaction chamber 410 with the pipette tip positioned near the bottom of the reaction chamber 410 in the well formed by the tapered edge 428. The reagent mixture 402 is thereafter drawn into the pipette 200 for use by a technician in various diagnostic, therapeutic procedures and the like. In some examples, the reagent preparation assembly 100 is configured to form a specified amount of reagent mixture 802 greater than a single pipette draw amount. Stated another way, the reagent preparation assembly 100 is configured to form multiple aliquots or doses of reagent mixture 802 for use in multiple therapeutic or diagnostic procedures (e.g., 50 microliters of reagent mixture or some specified volume).

Figure 9A:
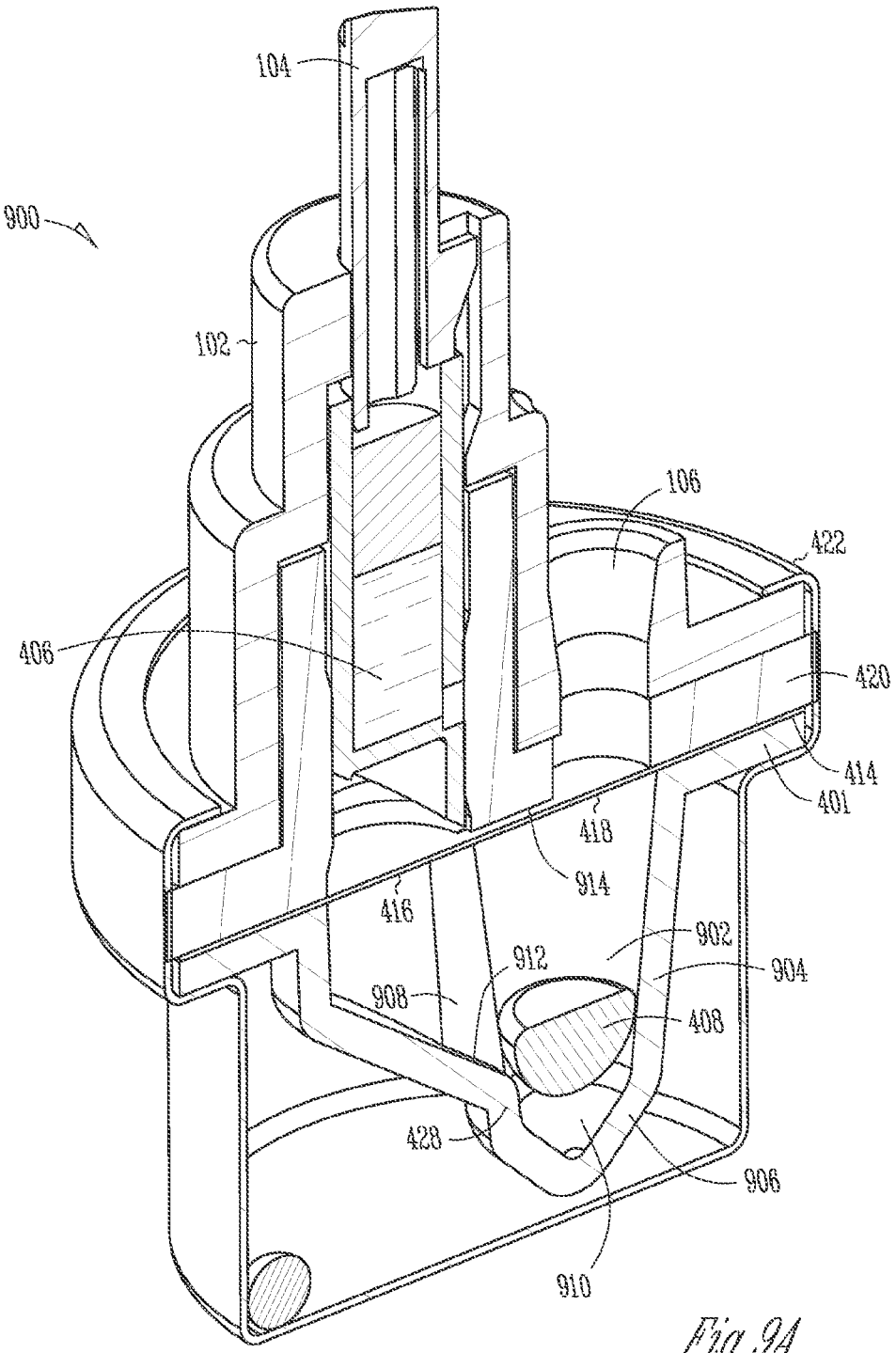
FIG. 9A is a cross-sectional view of another example of a reagent preparation assembly.

FIGS. 9A, B show another example of a reagent preparation assembly 900. The reagent preparation assembly 900 includes at least some of the features of the previously described reagent preparation assembly 100. For instance, the reagent preparation assembly 900 includes a plunger 104, a body 102, a reaction chamber 902 and a reagent 408 positioned therein as well as other previously described features and functions.

Referring first to FIG. 9A, the reaction chamber 902 is shown with the reagent 408 coupled along a reagent coupling surface 904 at least partly circumscribing a tapering chamber wall 906 of the reaction chamber. For instance, the reagent coupling surface 904 extends around the reagent 408 with a discontinuity at a solution channel 912 corresponding to the beveled edge 428. In one example, the reagent 408 is coupled along the reagent coupling surface 904. For instance, the reagent 408 is adhered, fixed, mechanically engaged and the like with the reagent coupling surface 904. Coupling of the reagent 408 along the reagent coupling surface 904 substantially fixes the reagent 408 in place within the reaction chamber 902 and thereby substantially prevents its movement and any corresponding damage caused by striking of the reagent 408, for instance while loose with the reaction chamber walls.

Figure 9B:
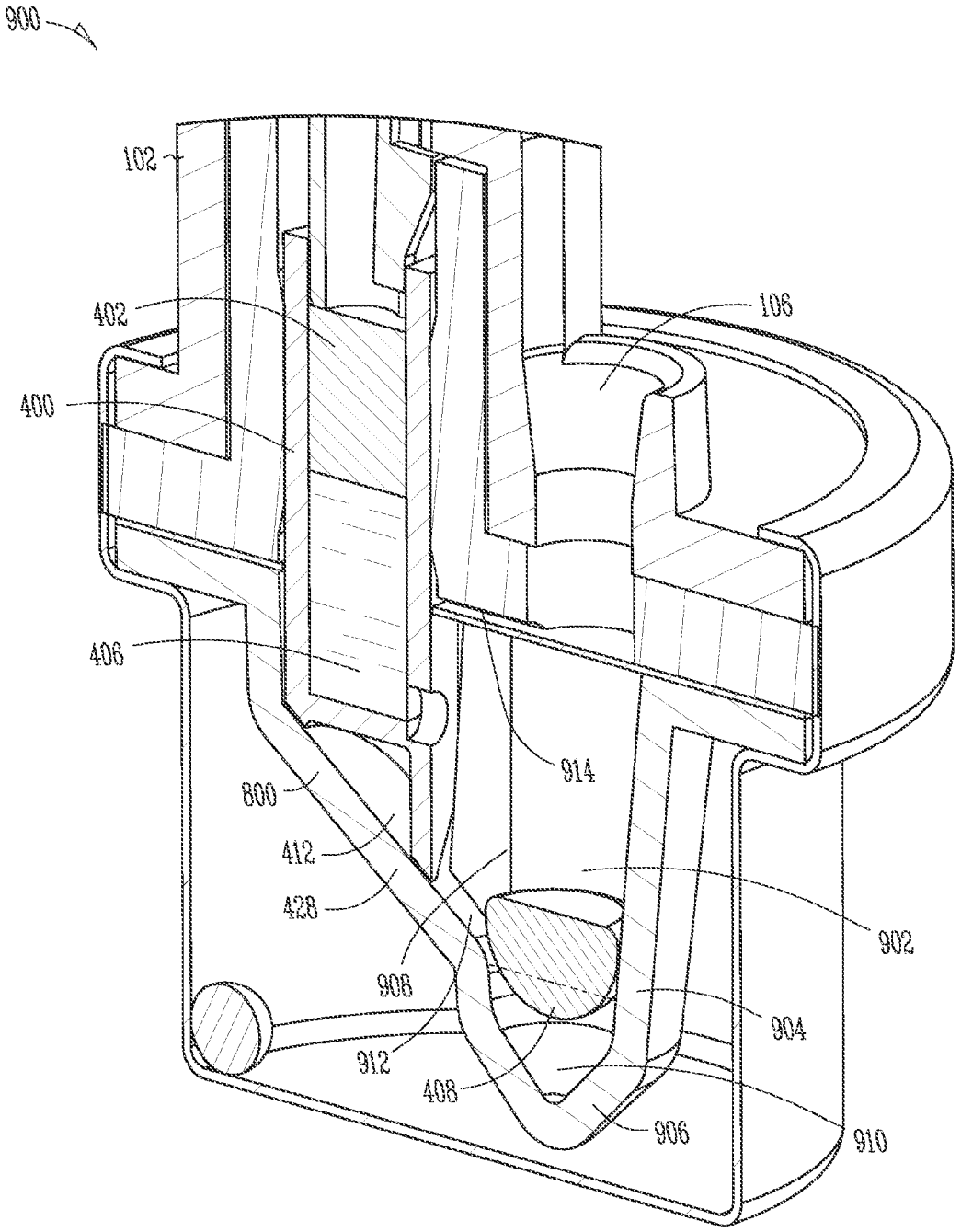
FIG. 9B is a detailed cross-sectional view of the reagent preparation assembly shown in FIG. 9A in an intermediate configuration.

The tapering reaction chamber 902 forms a well 908 that tapers toward a trough 910 positioned substantially beneath the access port 106. As previously described, tapering the well toward the area underneath the access port 106 facilitates delivery of an instrument tip such as a pipette tip to the bottom of the well 908 to ensure drawing of substantially all or a portion of the reagent mixture formed within the reaction chamber 902. As shown in FIGS. 9A and 9B, the tapering chamber wall 906 of the reaction chamber 902 is graduated and forms a trough 910 (e.g., the lowest point in the reaction chamber 902) sized and shaped to receive the reagent and solution and the corresponding reagent mixture formed by the mixing of the reagent 408 and the solution 406. Stated another way, the trough 910 substantially retains the reagent mixture therein and facilitates easy access to the reagent mixture by instruments positioned through and extending into the reaction chamber through the access port 106.

Referring now to FIG. 9B, the reagent preparation assembly 900 is shown again with the syringe in a depressed configuration with the piercing edge 412 seated along the reservoir base 800 including, for instance, the beveled edge 428. As previously described, operation of the plunger 104 in this configuration moves the piston 402 within the syringe 400 and moves the solution 406 into the reaction chamber 902. As shown in FIG. 9B, the beveled edge 428 forms a solution channel 912 configured to deliver the solution toward the reagent 408. For instance, the solution channel 912 extends between opposing surfaces of the reagent coupling surface 904 extending around the reaction chamber 902. Stated another way, the solution channel 912 is a discontinuity in the reagent coupling surface 904. The solution channel 912 thereby delivers the solution 406 into the portion of the reaction chamber 902 including the tapering chamber wall 906, the reagent 408 as well as the trough 910 formed by the tapering chamber wall 906. The solution thereby readily mixes with the reagent 408 at one location within the reaction chamber 902 and is thereafter substantially retained within the trough 910 of the reaction chamber 902. Delivering of an instrument through the access port 106, as previously described, into the tapering reaction chamber 902 (tapering as shown with the well 908) ensures the instrument is delivered to the reagent mixture within the trough 910 and thereby ensures that all or a portion of the mixture (if there are multiple aliquots) is drawn into the instrument. That is to say, the reagent mixture is substantially contained within the well 908 including the trough 910 and not spread throughout the reaction chamber 902 (see the dashed line in FIG. 9B). Where the reagent preparation assembly 900 is configured to prepare one or more aliquots of reagent mixture providing the tapered well 908 including the trough 910 substantially beneath the access port 106 ensures that each of the aliquots of the reagent mixture are positioned for ready drawing into an instrument positioned through the access port 106. Stated another way, all or substantially all of the reagent mixture is thereby available for delivery into an instrument and any pooling of the reagent mixture, for instance, along surfaces of an untapered chamber is thereby substantially minimized.

The reagent preparation assembly 900 further includes a vent path 914 shown in FIGS. 9A, B and previously described with regard to the reagent preparation assembly 100. As shown in FIGS. 9A, B, the vent path 914 is formed as a recess between the seal membrane 414 and the gasket 420. After piercing of the syringe seal 416 gases from the reaction chamber 902 pass through the vent path 914 to the exterior of the reagent preparation assembly 900. For example, as shown in FIGS. 9A, B the vent path 914 extends into the access port 106 thereby allowing communication between the reaction chamber 902 and the exterior environment during positioning of the syringe 400 in the reaction changer 902 and delivery of the solution 406 to the reaction chamber 902. Gases within the reaction chamber 902 thereby easily flow out to prevent overpressurizing with the chamber and maintaining the access seal 418 in an unruptured state until opening of the seal 418 is desired (e.g., when reagent mixture is withdrawn).

CONCLUSION

The reagent preparation assemblies described herein provide storage and reconstitution assemblies that are easy to use for a variety of diagnostic, life science research and testing purposes. Each assembly includes a specified amount of solution to mx with the loaded reagent (or reagents). The solution and reagent held in separate reservoirs and isolated until reconstitution is desired. The assemblies are storable for long periods of time and immediately usable. Additionally, because the assemblies include measured amounts of solution that reconstitute the reagent (or reagents) without leaving excess solution, a reagent solution having a specified concentration is consistently formed. Multiple aliquots, for instance 5 or more, are created at a desired time for immediate use without retaining or generating large volumes of a reagent mixture and storing the same. The attendant issues of storing larger volumes of a reagent mixture are thereby avoided including, spoilage, dilution, contamination and the like.

The all-in-one assemblies places the solution, the reagent, the mixing device and an access port in a single housing and thereby substantially eliminates user based variables that may negatively impact the quality and function of a reagent. The assemblies eliminate many measuring and handling steps so that high level manufacturing quality standards for the reagent are carried forward and maintained during preparation of the reagent. Proper preparation of the reagent with the assemblies described herein is thereby not dependent on the skill, experience, competency or technique of the user. Having the specified amount (one or more aliquots) and concentration of the reagent mixture ensures a testing or diagnostic scheme is accurately performed and provides the technician with a confident diagnostic or test result.

Further, the tapered well of the assemblies substantially ensures the solution and the reagent mix in a localized area within the reaction chamber. Moreover, the reagent mixture is retained substantially beneath the access port to ensure instruments extending into the reaction chamber have ready access to the mixture. Pooling or spreading of the reagent mixture in disparate areas of the reaction chamber is thereby avoided. Moreover, the positioning of the syringe within the reaction chamber partially fills the reaction chamber and further minimizes the displacement of the reagent mixture from the trough of the well. A technician is thereby able to readily and accurately withdraw each of the one or more doses from the reaction chamber with little or no portion of the reagent mixture retained in an inaccessible portion of the chamber.

The example assemblies described above include diagnostic and testing solutions and reagents. Each of the assemblies previously described and claimed herein is similarly applicable for use in therapeutic and pharmaceutical applications, such as drug reconstitution, administration and the like. To the extent reagents, mixtures and preparation assemblies are described and claimed herein, therapeutic and pharmaceutical reagents, mixtures and devices are similarly considered within the scope of the description, figures and the claims.

In the foregoing description, the subject matter has been described with reference to specific exemplary examples. However, it will be appreciated that various modifications and changes may be made without departing from the scope of the present subject matter as set forth herein. The description and figures are to be regarded in an illustrative manner, rather than a restrictive one and all such modifications are intended to be included within the scope of the present subject matter. Accordingly, the scope of the subject matter should be determined by the generic examples described herein and their legal equivalents rather than by merely the specific examples described above. For example, the steps recited in any method or process example may be executed in any order and are not limited to the explicit order presented in the specific examples. Additionally, the components and/or elements recited in any apparatus example may be assembled or otherwise operationally configured in a variety of permutations to produce substantially the same result as the present subject matter and are accordingly not limited to the specific configuration recited in the specific examples.

Benefits, other advantages and solutions to problems have been described above with regard to particular examples; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present subject matter, in addition to those not specifically recited, may be varied or otherwise particularly adapted to specific environments, manufacturing specifications, design parameters or other operating requirements without departing from the general principles of the same.

The present subject matter has been described above with reference to examples. However, changes and modifications may be made to the examples without departing from the scope of the present subject matter. These and other changes or modifications are intended to be included within the scope of the present subject matter, as expressed in the following claims.

It is to be understood that the above description is intended to be illustrative, and not restrictive. Many other examples will be apparent to those of skill in the art upon reading and understanding the above description. It should be noted that examples discussed in different portions of the description or referred to in different drawings can be combined to form additional examples of the present application. The scope of the subject matter should, therefore, be determined with reference to the appended claims, along with the full scope of equivalents to which such claims are entitled.

What is claimed is:

1. A method of reconstituting and withdrawing a reagent comprising:

depressing a plunger of a reconstitution assembly from an initial position to a piercing position, the plunger is engaged with a syringe from the initial position to the piercing position, and depressing the plunger pierces a syringe seal with the syringe, wherein:

the syringe seal closes a reaction chamber, the reaction chamber is coupled with a body, wherein the body includes:

a syringe passage extending toward the reaction chamber, and a syringe port, wherein the syringe seal isolates the syringe passage from the reaction chamber, and an access port extending toward the reaction chamber, and the access port is configured to receive an instrument;

depressing the plunger from the piercing position to a solution moving position to move a solution from the syringe into the reaction chamber, depressing the plunger from the piercing position to the solution moving position includes:

automatically disengaging the plunger from the syringe, automatically engaging the plunger with a piston, and moving the solution from the syringe to the reaction chamber according to movement of the plunger engaged with the piston; and mixing the solution with an unreconstituted reagent within the reaction chamber to form a reagent mixture.

2. The method of claim 1, wherein a deflectable tongue engages the plunger with the syringe, and automatically disengaging the plunger from the syringe includes deflecting the deflectable tongue with a camming surface.

3. The method of claim 1, wherein automatically engaging the plunger with the piston includes automatically engaging the plunger with the piston after automatically disengaging the plunger from the syringe.

4. The method of claim 1, wherein automatically engaging the plunger with the piston includes engaging a plunger post with the piston after the plunger is disengaged from the syringe.

5. The method of claim 1, wherein moving the solution from the syringe to the reaction chamber includes moving the piston within the syringe to push the solution from the syringe into the reaction chamber.

6. The method of claim 1, wherein depressing the plunger from the piercing position to the solution moving position includes moving at least a portion of the syringe including a syringe orifice in communication with a solution reservoir containing the solution into the reaction chamber.

7. The method of claim 1, wherein depressing the plunger from the piercing position to the solution moving position includes seating the syringe along a surface of the reaction chamber.

8. The method of claim 1, wherein mixing the solution with the unreconstituted reagent includes mixing within a tapered well underlying the access port, the access port configured to receive an instrument.

9. The method of claim 1 comprising:

drawing at least a portion of the reagent mixture into an instrument positioned in the reaction chamber through the access port.

10. The method of claim 1, wherein depressing the plunger from the initial position to the piercing position, and depressing the plunger from the piercing position to the solution moving position includes continuous depressing of the plunger from the initial position to the solution moving position.

* * * * *